US006588306B1

(12) United States Patent
Grossman et al.

(10) Patent No.: US 6,588,306 B1
(45) Date of Patent: Jul. 8, 2003

(54) DEFORMABLE WRENCH

(75) Inventors: Vitaly Grossman, West Bloomfield, MI (US); Richard A. Close, Farmington Hills, MI (US); Robert D Cross, Sterling Hts., MI (US); Mark G. Laskowski, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/015,451

(22) Filed: Dec. 13, 2001

(51) Int. Cl.[7] ..... B25B 23/14

(52) U.S. Cl. ..... 81/467; 81/124.3; 411/427

(58) Field of Search ..... 81/467, 64, 124.3, 81/124.7; 411/427, 429, 533, 432

(56) References Cited

U.S. PATENT DOCUMENTS

| | | | | |
|---|---|---|---|---|
| 2,800,816 A | * | 7/1957 | Tasciotti | 81/120 |
| 4,791,837 A | | 12/1988 | Main | 81/53.1 |
| 5,297,458 A | | 3/1994 | Smith et al. | 81/124.3 |

* cited by examiner

*Primary Examiner*—D. S. Meislin
(74) *Attorney, Agent, or Firm*—Laura C. Hargitt

(57) ABSTRACT

A deformable wrench for applying torque to a nut engaging a threaded fastener includes a wrench body having a center portion with at least one wing portion extending therefrom. The wrench body is formed from an elastic material and a socket aperture extends through the central portion between spaced upper and lower surfaces thereof. The socket aperture is configured to cooperate with the profile of the nut to permit rotation relative to the fastener by applying force to the wing portion of the wrench. At a predetermined torque value, the walls of the socket aperture deform to permit rotation of the wrench relative to the nut thereby preventing over-torquing the nut on the fastener.

6 Claims, 3 Drawing Sheets

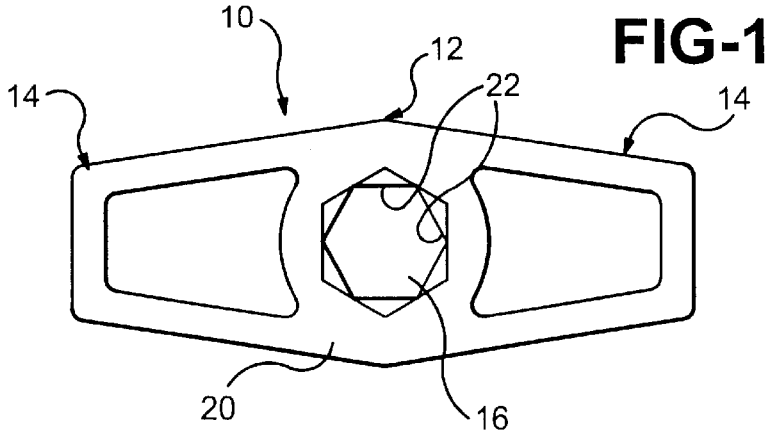
FIG-1
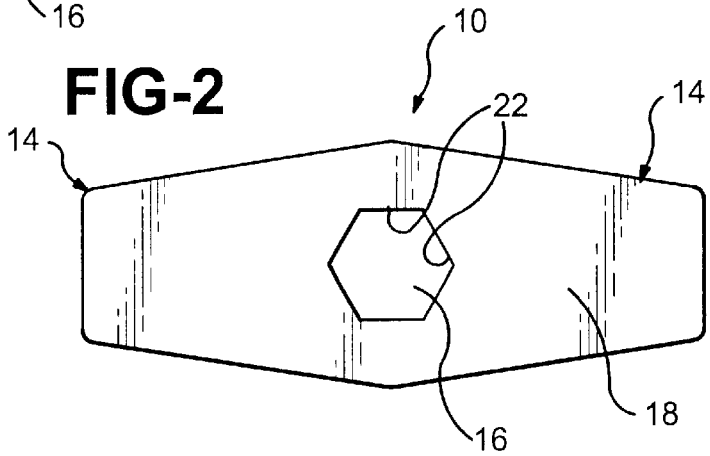
FIG-2
FIG-3
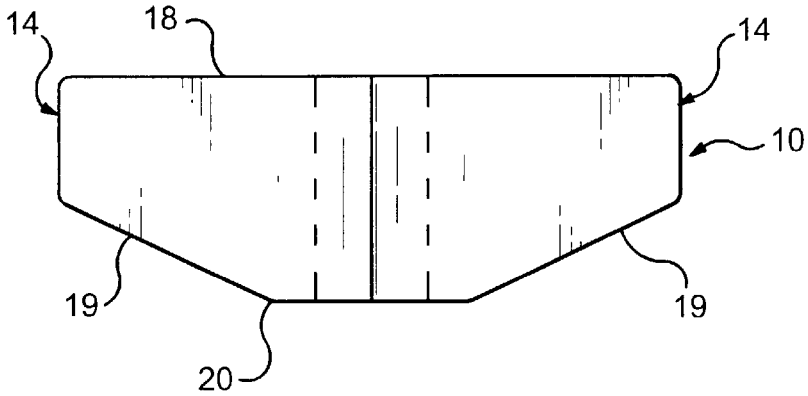
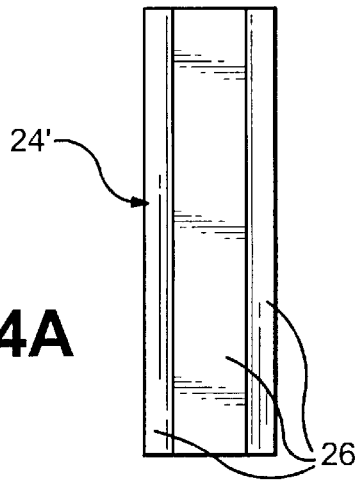
FIG-4A

DEFORMABLE WRENCH

BACKGROUND OF THE INVENTION

The present invention relates generally to wrenches and, in particular, to a deformable wrench for an antenna assembly.

There are many situations where systems, mechanisms, or devices are assembled at a point of delivery where it is disadvantageous to attach a nut to a bolt or stud with too much or too little torque. Torque wrenches, however, are expensive and at times cumbersome to use. In addition, setting the torque wrench requires following detailed instructions, often difficult when installing systems, mechanisms or devices at the point of delivery.

An example of such a mechanism to be assembled at the point of delivery is an automotive vehicle antenna assembly. A typical antenna assembly includes a coaxial cable attached to a central conductor having a threaded stud formed on an end extending from a surface of the vehicle. An antenna mast is typically attached to the central conductor by an antenna mast nut. The mast extends for a given distance beyond the surface of the vehicle and although it is flexible, it is prone to breakage if bent with enough force. A greater danger for bending the antenna exists during delivery of the vehicle, whether on rail or truck, because of the tight vertical space restrictions for these carriers. Because of this danger, radio antennas are typically installed at the point of delivery, often an automotive dealership. In order to function properly, the antenna mast must be attached with the correct amount of torque. If the antenna is assembled with too much torque, the coaxial connections can be stripped, rendering the antenna inoperable. In addition, too much torque can chip the paint on the antenna mast nut. As a result, care is taken to not chip the paint on the mast nut, often resulting in an undesirable low amount of torque on the antenna mast nut. If the antenna is assembled without enough torque, the threaded stud may bend during normal vehicle operation or during automatic car washes, and eventually break. In addition, too little torque may result in poor electrical connection and lost reception.

It is desirable to provide a portable and inexpensive means for applying the proper amount of torque for attaching a fastener. It is desirable to provide a means for applying the proper amount of torque that does not chip or damage the coating of the fastener. It is desirable to provide a means for applying torque that will not over-torque the fastener. It is desirable to provide a reusable means for applying torque to a fastener.

It is an object of the invention, therefore, to provide a wrench that applies a proper amount of torque to a fastener without damaging the fastener or any coating on the fastener and that will not provide an excessive torque to the fastener. It is also an object of the invention to provide a wrench that is reusable.

It is another object of the invention to provide an antenna assembly that includes a wrench for applying the proper amount of torque to a fastener that may be advantageously reused.

SUMMARY OF THE INVENTION

The present invention solves the problems of the prior art and accomplishes the objectives noted above by providing a novel deformable wrench. The wrench is shaped generally like a wing nut and includes wing portions extending outwardly from a center portion. A socket aperture extends through a top and a bottom surface of the center portion and receives a fastening means. The fastening means may include, but is not limited to, a nut or the head of a bolt. Preferably, the walls of the socket aperture are of a smooth bore type. Alternatively, the walls of the socket aperture include an inwardly extending lip formed at an upper portion of the aperture. Preferably, the socket is hexagonal in shape. Alternatively, the socket may be shaped to fit various fastener profiles. The wrench is preferably sized to be manipulated by hand. The wrench is preferably constructed of an elastic material, such as, but not limited to, polypropylene. Importantly, the properties of the elastic material are such that the flex modulus of the wrench material cooperates with the geometry of the socket aperture to allow the socket aperture walls to deform elastically once a certain torque value has been reached. When elastically deformed, the walls of the socket aperture flex outwardly and "strip" past the points of the fastener, advantageously not allowing the wrench to apply more torque to the fastener. The wrench, after elastically deforming, advantageously assumes its original form and shape because of the properties of the elastic material of the wrench. The elastic material may be supplied from recycled material.

The present invention may be advantageously applied to any type of fastener where it is desirable to apply a torque amount without damaging the fastener or the fastener coating and without applying a torque amount greater than that is required. Because the socket aperture of the present invention extends through the upper and lower surfaces of the wrench, the wrench may also advantageously be used to apply a torque to fastening means attached to elongated studs or bolts. Alternatively, the wrench may be applied to a fastening means having a flange formed thereon for cooperating with the alternative inwardly extending lip of the socket aperture.

Furthermore, the wrench of the present invention may be made part of an automotive antenna assembly. The assembly includes an elongated antenna mast having a mast nut on one end. The antenna mast nut is preferably formed from hexagonally shaped stock. An end of the antenna mast nut is machined to form a rounded flange. The portion of the antenna mast nut directly abutting the flange includes a machined groove having a smaller diameter than the flange. The wrench receives the hexagonal antenna mast nut in the socket aperture. The lip on the walls of the socket aperture cooperates with the rim flange and groove to form a snap-fit connection that serves to retain the wrench in place on the mast nut and align the wrench with the hexagonal surface of the mast nut. The wrench is then used for applying a torque to the mast nut during installation of the antenna mast and assembly, while advantageously not chipping the paint coating of the mast nut. After use, the wrench may then be removed from the mast nut and placed in the automobile for possible future reuse.

The present invention may be constructed with various values of flex modulus to cooperate with various shapes and profiles of the socket aperture. The wrench is not limited to a generally wing-nut shape, but may also be shaped in various ways that are ergonomically suitable for hand-tightening of fasteners.

The present invention is particularly adaptable to build-at-home assembly kits having multiple fasteners where torque values are critical but where traditional torque wrenches are too expensive, too bulky, or too heavy to be made part of the assembly kit. The present invention may be advantageously placed in the packaging material. The present invention is more adaptable to smaller torque values that may be applied by a person using one hand, but the wing sections could be extended to provide additional torque, with a corresponding increase in the flex modulus properties of the elastic material.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a bottom plan view of a deformable wrench in accordance with the present invention;

FIG. 2 is a top plan view of the deformable wrench shown in FIG. 1;

FIG. 3 is a side elevation view of the deformable wrench shown in FIG. 1;

FIGS. 4 and 4*a* are side elevation views of fasteners in accordance with the present invention;

DESCRIPTION OF THE PREFERRED EMBODIMENT

Figure 4:
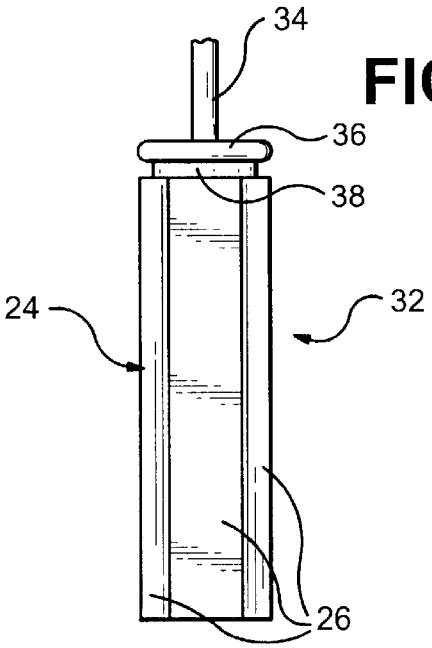

Referring now to all of the drawing figures, a deformable wrench according to the present invention is indicated generally at 10. The wrench 10 has a generally elongated hexagonal cross-section and includes a center portion 12 having two wing portions 14 extending outwardly therefrom. The wrench 10 is sized to be easily manipulated by one hand of a person (not shown) using the wrench 10. A socket aperture 16 extends through the center portion 12 between an upper surface 18 and a lower surface 20 of the center portion 12. The socket aperture 16 defines a plurality of interior walls 22. The socket aperture 16 is adapted to fit the profile of a fastening means 24 or 24'. A lower surface 19 of the wing portions 14 preferably tapers upwardly from the lower surface 20 of the center portion 12, best seen in FIG. 3. The tapered lower surfaces 19 of the wing portions 14 reduce the overall weight and amount of material required for the wrench 10. The tapered lower surfaces 19 also advantageously provide more clearance for the wing portions 14 to clear any obstructions on a surface (not shown) to which the fastening means 24 or 24' is being attached when the wrench 10 is being rotated about a central axis of the socket aperture 16. Alternatively, the bottom surfaces 19 are not tapered (not shown). The wrench 10 may also have a generally rectangular cross-section (not shown), or any other cross-section with which a torque may be generated by hand.

The socket aperture 16 is adapted to receive the fastening means 24 or 24' and is preferably hexagonal but, alternatively, may have any shape that corresponds to the profile of the fastener to be rotated. The fastening means 24 or 24', best seen in FIGS. 4 and 4*a*, includes a plurality of flat surfaces 26, or flats, formed thereon. The fastening means 24 or 24' is preferably a nut threadably engaging a fastener such as a bolt, a head of a bolt threadably engaging a fastener such as a bolt hole, or the like. The walls 22 of the socket aperture 16 and the flats 26 of the fastening means 24 or 24' preferably have a close, abutting relationship in order that the wrench 10 may provide a torque to the fastening means 24 or 24'.

The wrench 10 is preferably constructed of an elastic material including, but not limited to, polypropylene. The elastic material may be supplied from recycled plastic material. The elastic material preferably possesses a flex modulus that, in combination with the geometry of the socket aperture 16, corresponds to a predetermined torque value when the wrench 10 applies a torque to the fastening means 24 or 24'. Because the flex modulus properties of the elastic material and the geometry of the socket aperture 16 define the predetermined torque value, the wrench 10 is able to be adapted to deform at any single torque value in a range of torque values, limited only by the flex modulus properties of the elastic material, the geometry of the socket aperture 16, and the shape of the fastening means 24 or 24'.

Figure 5:
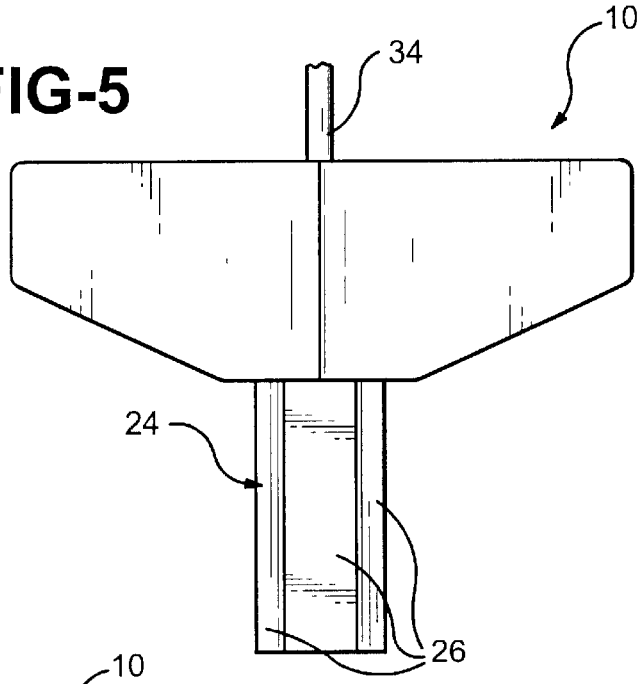
FIGS. 5 and 5*a* are side elevation views of the deformable wrench shown in FIG. 1 assembled with the fasteners shown in FIGS. 4 and 4*a* respectively.
Figure 5A:
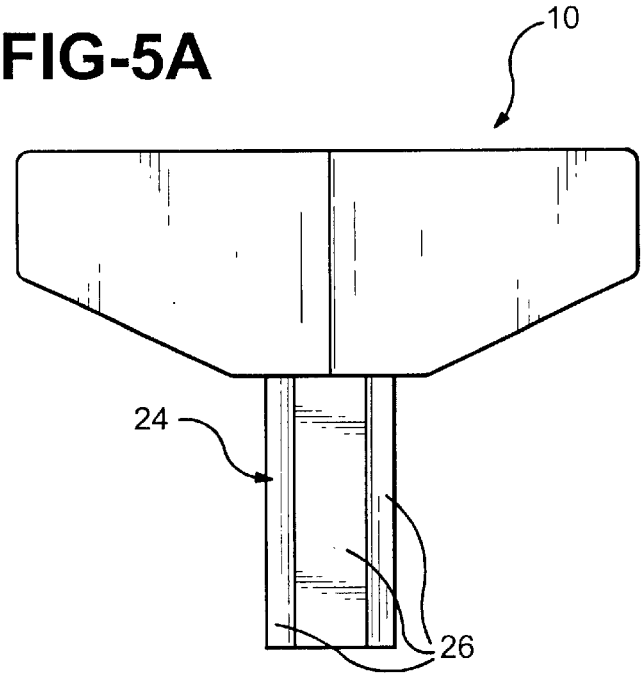
Figure 6:
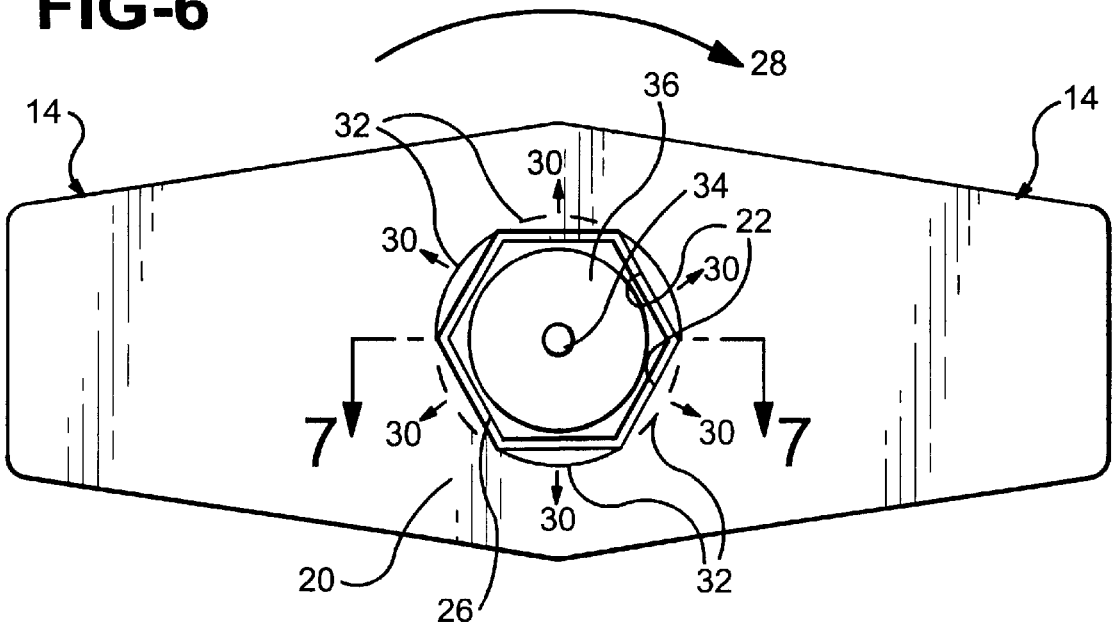
FIG. 6 is a top plan view of the assembled deformable wrench and antenna mast nut shown in FIG. 5 including lines of elastic deformation.

When ready for use, the wrench 10 is placed on the fastening means 24 or 24', best seen in FIGS. 5 and 5*a*. A torque is applied, preferably by hand (not shown), to the wrench 10 in a direction depicted by an arrow 28, best seen in FIG. 6, that corresponds to the tightening direction for the fastening means 24 or 24'. The walls 22 of the socket aperture 16 cooperate with the flats 26 of the fastening means 24 or 24' to apply torque to the fastening means 24 or 24'. When the torque applied to the fastening means 24 or 24' reaches the predetermined torque value, each of the walls 22 of the socket aperture 16 elastically deform outwardly in directions depicted by multiple arrows 30, best seen in FIG. 6. The walls 22 of the aperture 16 will elastically deform approximately to the diameter of an imaginary line 32, or at least until the diameter of the aperture 16 approaches the maximum diameter of the flats 26 of the fastening means 24 or 24'. When elastically deformed, the walls 22 of the socket aperture 16 will "strip" past the flats 26 of the fastening means 24 or 24', not allowing the walls 22 to cooperate with the flats 26. The deformation of the socket walls 22 thus advantageously does not allow the wrench 10 to apply any more torque to the fastening means 24 or 24'. The wrench 10 is then removed from the fastening means 24 or 24'. After being elastically deformed and then removed from the fastening means 24 or 24', the elastic material of the wrench allows the walls 22 of the socket aperture 16 to return to their original profile that correspond to the flats 26 of the fastening means 24 or 24'. After the walls 22 have returned to their original position, the wrench 10 may then be reused advantageously with another fastening means 24 or 24'.

Figure 7:
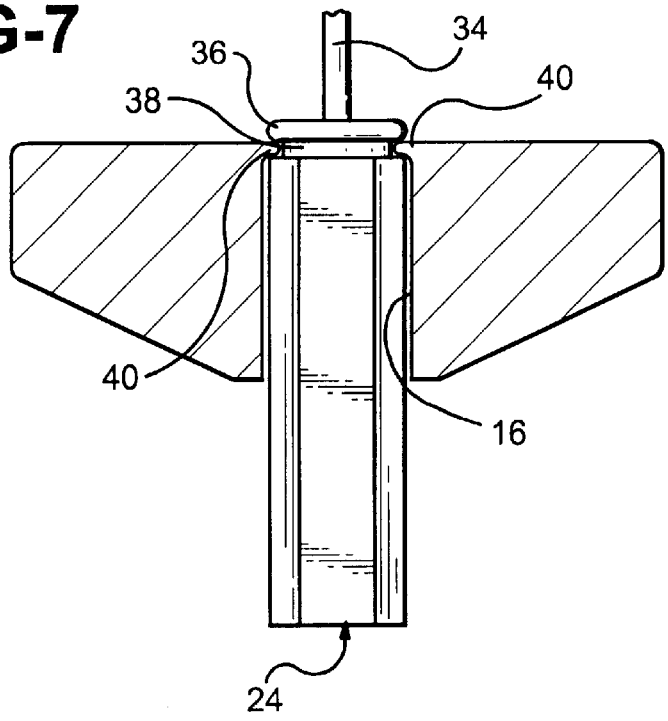
FIG. 7 is a fragmentary cross-sectional view taken along line 7—7 in FIG. 6.

Referring now to FIG. 4, a partial antenna assembly is indicated generally at 32. The antenna assembly 32 includes an elongated cylindrical antenna mast 34 having the fastener 24 attached to an end thereof. The fastener 24 is formed of hexagonal-shaped stock and includes an end that is machined to form a rounded shoulder 36. A machined portion of the fastener 24 directly abutting the shoulder 36 includes an annular groove 38 having a diameter smaller than the diameter of the shoulder 36. Referring now to FIG. 7, the socket aperture 16 alternatively includes a lip 40 extending inwardly from the walls 22 of the socket aperture 16. The lip 40 aids in retaining the wrench 10 to the fastener 24 when torque is applied to the fastener 24. The lip 40 also aids in vertically aligning the wrench 10 with the fastener 24. The lip 40 is elastically deformable in the same manner as the walls 22 of the socket aperture 16 noted above. When the socket aperture 16 of the wrench 10 receives the fastener 24, the lip 40 deforms inwardly (not shown) to traverse the shoulder 36. Once beyond the shoulder 36, the lip 40 returns to its original profile and the machined groove 38 cooperates with the lip 40, best seen in FIG. 7, affixing the wrench 10 to the fastener 24. The wrench 10 is preferably a part of the antenna assembly 32, with wrench 10 attached to the fastener 24 prior to delivery so that the assembly 32 may be attached directly to a threaded stud (not shown) extending from a surface (not shown), such as an automobile body, at the point of delivery.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An antenna and wrench assembly for attaching an antenna mast to a vehicle comprising:

an elongated antenna mast having an end;

a nut attached to said end of said antenna mast, said nut being formed with a predetermined profile and having a flange formed on one end thereof with an annular groove adjacent said flange;

a wrench formed from an elastic material and having a center portion with at least one wing portion extending therefrom;

said center portion having a socket aperture formed therein receiving said nut, said socket aperture being configured to cooperate with an external profile of said nut, said center portion including a radially inwardly extending lip in said socket aperture releasably engaging said groove; and whereby when said nut is threadably engaged with a fastener on a vehicle, force exerted on said one wing portion will apply torque to rotate said wrench and said nut in a nut-tightening direction relative to the fastener, and wherein said center portion deforms when the applied torque exceeds a predetermined value thereby permitting said wrench to rotate relative to said nut to prevent over-torquing said nut on the fastener.

2. The assembly according to claim 1 wherein when the force is removed, said center portion of said wrench returns to an original shape such that said socket aperture is configured to cooperate with the external profile of the nut.

3. The assembly according to claim 1 wherein said elastic material is polypropylene.

4. The assembly according to claim 1 wherein said wrench includes at least another wing portion extending from said center portion.

5. The assembly according to claim 1 wherein said lip can be deformed to release from said groove to permit said wrench to be removed from said nut.

6. The assembly according to claim 1 wherein said nut has a hexagonal profile.

* * * * *